US005186396A

United States Patent [19]

Wise et al.

[11] Patent Number: 5,186,396

[45] Date of Patent: Feb. 16, 1993

[54] APPARATUS FOR SPREADING GRANULAR AND LIQUID MATERIALS

[76] Inventors: James J. Wise, 3020 Mason Ave., Las Vegas, Nev. 89102; John A. Doherty, 1 Round Hill Rd., Granby, Conn. 06035

[21] Appl. No.: 830,175

[22] Filed: Jan. 31, 1992

[51] Int. Cl.[5] ..... B05B 12/00

[52] U.S. Cl. ..... 239/675; 239/677; 239/684

[58] Field of Search ..... 239/61, 62, 662, 663, 239/670, 672, 675, 677, 684, 127, 71, 74; 180/53.4; 414/518, 526, 528

[56] References Cited

U.S. PATENT DOCUMENTS

| | | | |
|---|---|---|---|
| 3,344,993 | 10/1967 | Wilder et al. | 239/663 |
| 3,420,451 | 1/1969 | Kahlbacher | 239/675 |
| 3,559,894 | 2/1971 | Murray et al. | 239/672 |
| 3,776,421 | 12/1973 | Riley | 239/677 |
| 4,234,109 | 11/1980 | Goodhart | 239/675 |
| 4,260,107 | 4/1981 | Jackson | 239/74 |
| 4,442,979 | 4/1984 | Küpper | 239/663 |
| 4,881,371 | 11/1989 | Haeder et al. | 180/53.4 |

FOREIGN PATENT DOCUMENTS

| | | | |
|---|---|---|---|
| 3712452 | 11/1988 | Fed. Rep. of Germany . | |
| 2229812 | 12/1974 | France | 239/662 |
| 2378132 | 9/1978 | France | 239/662 |
| 516050 | 7/1968 | Switzerland . | |

*Primary Examiner*—Kevin P. Shaver
*Assistant Examiner*—Karen B. Merritt
*Attorney, Agent, or Firm*—Ralph F. Crandell

[57] ABSTRACT

A granular and liquid material spreading system mounted on a vehicle. Granular material is moved from a hopper to a delivery system using hydraulic pumps and motors. The hydraulic system also drives a liquid delivery system. A control system including a material computer is provided to control the amount of granular material and liquid material applied to a surface. The feed rate of liquid delivery is controlled electronically by programming the material computer as a function of the feed rate of the granular material. The liquid feed rate may be changed within a predetermined range. The level of liquid may be sensed to disengaged the liquid delivery system. Initiation of liquid delivery reduces the feed rate of granular material by a variably selected percentage.

5 Claims, 9 Drawing Sheets

APPARATUS FOR SPREADING GRANULAR AND LIQUID MATERIALS

CROSS REFERENCE TO RELATED APPLICATION

The present application is a continuation-in-part of U.S. patent application Ser. No. 07/592,924, filed Oct. 3, 1990, which is now U.S. Pat. No. 5,096,125 and which is a continuation-in-part of U.S. patent application Ser. No. 07/547,950, filed Jul. 3, 1990 which has been abandoned.

BACKGROUND OF THE INVENTION

1. Field of the Invention

The present invention relates to apparatus for spreading granular and liquid materials on road surfaces. More particularly, the invention relates to a granular material spreader and liquid material dispenser mounted on a vehicle for the synchronous dispensing of solid and liquid thawing materials onto a road surface.

2. Description of the Prior Art

Spreader vehicles or spreader implements for distributing ice thawing and traction enhancing materials on roads are known. Such spreader vehicles have a granular material hopper and delivery system, and can include a liquid delivery system, wherein a gravity feed system or a liquid pump supplies thawing liquid from a tank carried by the vehicle. A granular and liquid material spreader is shown in W. Küpper, U.S. Pat. No. 4,442,979. The Küpper patent also shows synchronized delivery of both liquid and granular materials according to the speed of travel of the vehicle, an example of ground speed control. Küpper can deliver only liquid, only granular material or a combination of the two, all proportional to the speed of the vehicle.

Another spreader apparatus known in the art comprises a spreader for granular and liquid materials comprising a vehicle including a hydraulic system, a storage hopper mounted on said vehicle for containing granular material, a granular material delivery apparatus including a conveyor driven by said hydraulic system for moving the granular material from the hopper to a delivery position and means at said delivery position for receiving and distributing said granular material onto the roadway surface, a controller for controlling the speed of said conveyor, means for sensing conveyor speed and generating a conveyor speed signal, a liquid storage tank mounted on said vehicle, a liquid material delivery apparatus including a conduit for supplying liquid material from said tank to a delivery position and means at said delivery position for distributing said liquid. This apparatus has been sold and commercially distributed under the tradename EPOKE.

OBJECTS AND SUMMARY OF THE INVENTION

It is the principal object of the present invention to provide an improved control for synchronizing the feed rate of granular and liquid materials in a material spreader.

In accordance with the principal object of the invention, a vehicle such as shown and described in my U.S. Pat. No. 5,096,125, for Apparatus for Synchronized Spreading of Granular and Liquid Material, has mounted thereon a granular material delivery system and a thawing liquid delivery system. The granular material, such as salt, gravel, sand and other materials can be used separately or in combination with the liquid, typically calcium chloride, for thawing road surfaces during winter months. A hydraulic system powers the delivery system's aggregate material conveyor to deliver the granular material from a hopper to a spinner, which distributes the granular material. The spinner is powered by the same hydraulic system, and together the hydraulic system, hopper, conveyor and spinner define the granular material delivery apparatus.

The liquid delivery system is mechanically, electronically or hydraulically connected to the granular delivery apparatus. A motor drives a liquid pump which pumps liquid from a tank to the dispenser nozzles. The feed rate control for the liquid delivery system is interconnected to the feed rate control for the granular material delivery system for synchronous operation.

None, a portion or all of the hydraulic flow from the granular delivery apparatus may be fed to the motor that powers the liquid delivery system or, in some embodiments, returned to a hydraulic reservoir. In either event, the feed rate of the granular delivery system is proportionately changed or altered, depending upon the amount of hydraulic fluid flow to the granular delivery system. The amount of liquid delivered is proportional to the quantity of granular material delivered. The amount of hydraulic fluid flow to the granular delivery apparatus ranges from 0 to approximately 95 percent of the hydraulic fluid output of the vehicle hydraulic system depending on the embodiment chosen and the road conditions the operator of the vehicle may experience.

The flow of hydraulic fluid to the granular material conveyor is controlled by a ground speed sensitive controller. A vehicle speed sensor generates signals which are proportional to the vehicle's speed. A conveyor speed sensor generates signals which optimally are used as input for the ground speed control in a feedback control circuit to maintain the selected speed. In a conventional ground speed control this speed sensor signal input controls the speed of the aggregate material conveyor.

In the present invention the speed sensor and conveyor speed sensor signals are fed to a material computer. The material computer, based on the selected amount of aggregate material, increases or decreases the amount of liquid applied. The material computer additionally receives the speed sensor and conveyor speed sensor signals and then supplies adjusted signals to the ground speed computer to control conveyor speed.

Where the granular material feed rate is otherwise reduced by the connection to and activation of the liquid delivery system, the operator still can vary the respective feed rates within a predetermined range. The operator can select the correct material mix to control road conditions.

Other aspects, features and details of the present invention can be more completely understood by reference to the following detailed description of the preferred embodiments, taken in conjunction with the drawings, and from the appended claims.

DESCRIPTION OF THE PREFERRED EMBODIMENTS

Figure 1:
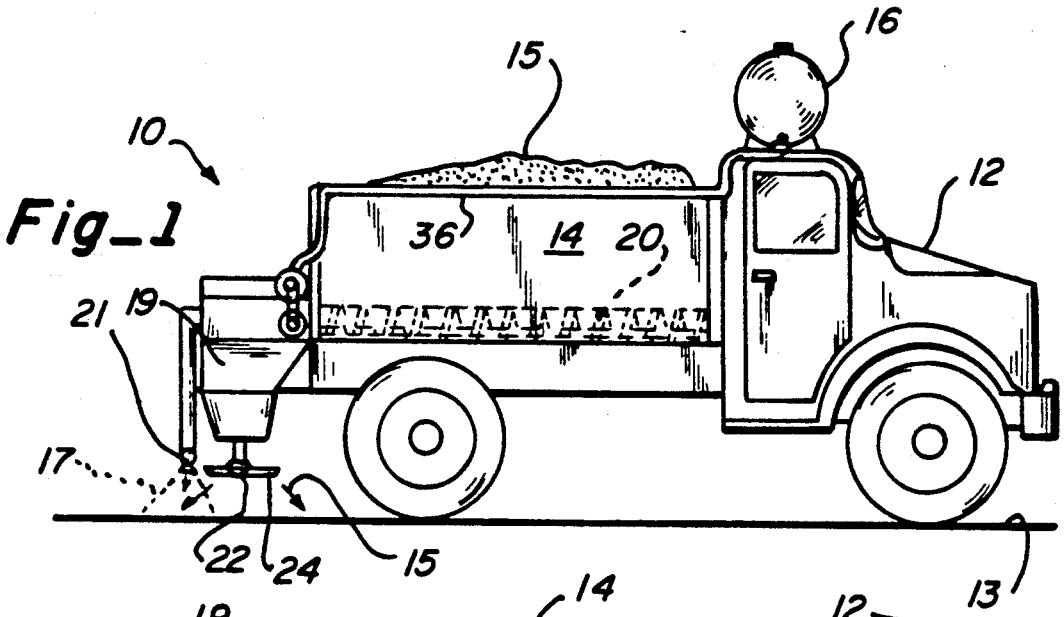
FIG. 1 is a side elevational view of a vehicle carrying the granular and liquid material control device of the present invention.
Figure 2:
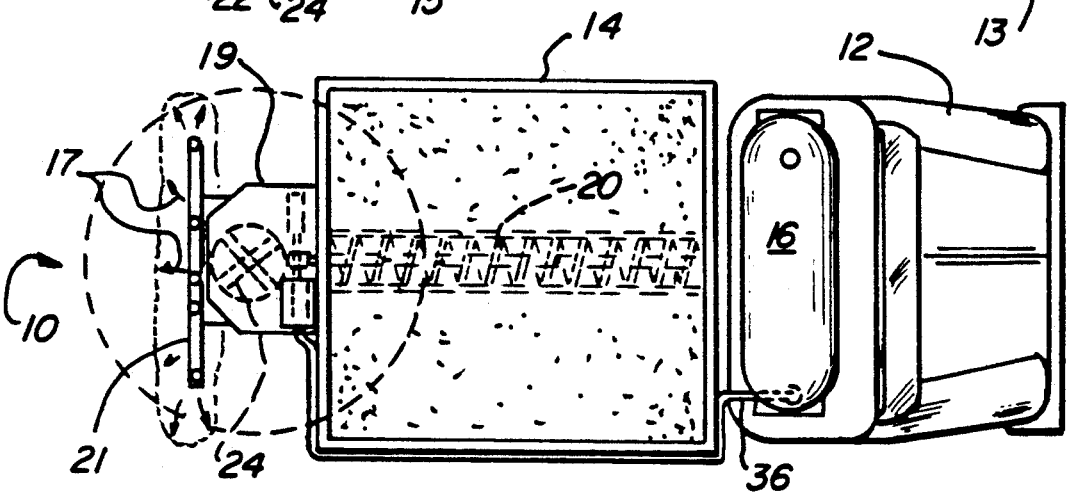
FIG. 2 is a top plan view of the vehicle shown in FIG. 1.
Figure 3:
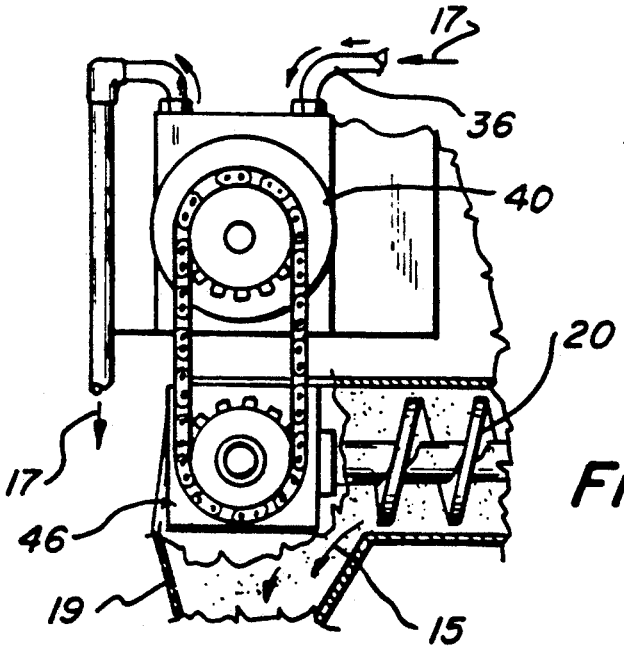
FIG. 3 is a fragmentary schematic view showing a typical mechanical embodiment for connecting a conveyor of a granular material delivery system to a liquid material delivery system.

The present invention is embodied in an improved synchronized control for a granular and liquid spreader 10 apparatus mounted on a vehicle 12 for spreading granular material 15 and a thawing liquid 17 onto a road surface 13 (FIGS. 1-3). The granular material 15 may be salt, sand or gravel for traction, or any solid or aggregate material that may be spread onto the road 18. The liquid 17 may be calcium chloride, sodium chloride or other chloride compound liquid, as well as any other wetting or thawing agent. The granular material 15 and thawing liquid 17 are applied when the road 13 has ice or snow covering it which needs to be melted. These situations occur on public streets and highways as well as in and around public transportation areas such as airports.

The granular material 15 is carried in a hopper 14 or similar device mounted on the vehicle 12. The hopper 14 is opened to deposit the granular material 15 onto a conveyor 20, which moves the granular material 15 to a drop chute 19 at a delivery position where the granular material 15 falls onto a spinner 24. The spinner 24 is rotated by a spinner motor 22 to define delivery means for spreading the granular material 15 onto the road surface 13 (FIG. 1).

The liquid 17 is stored in a tank 16 and pumped to nozzles 21 at the delivery position. The liquid may be applied either directly to the road or onto the spinner 24.

Figure 4:
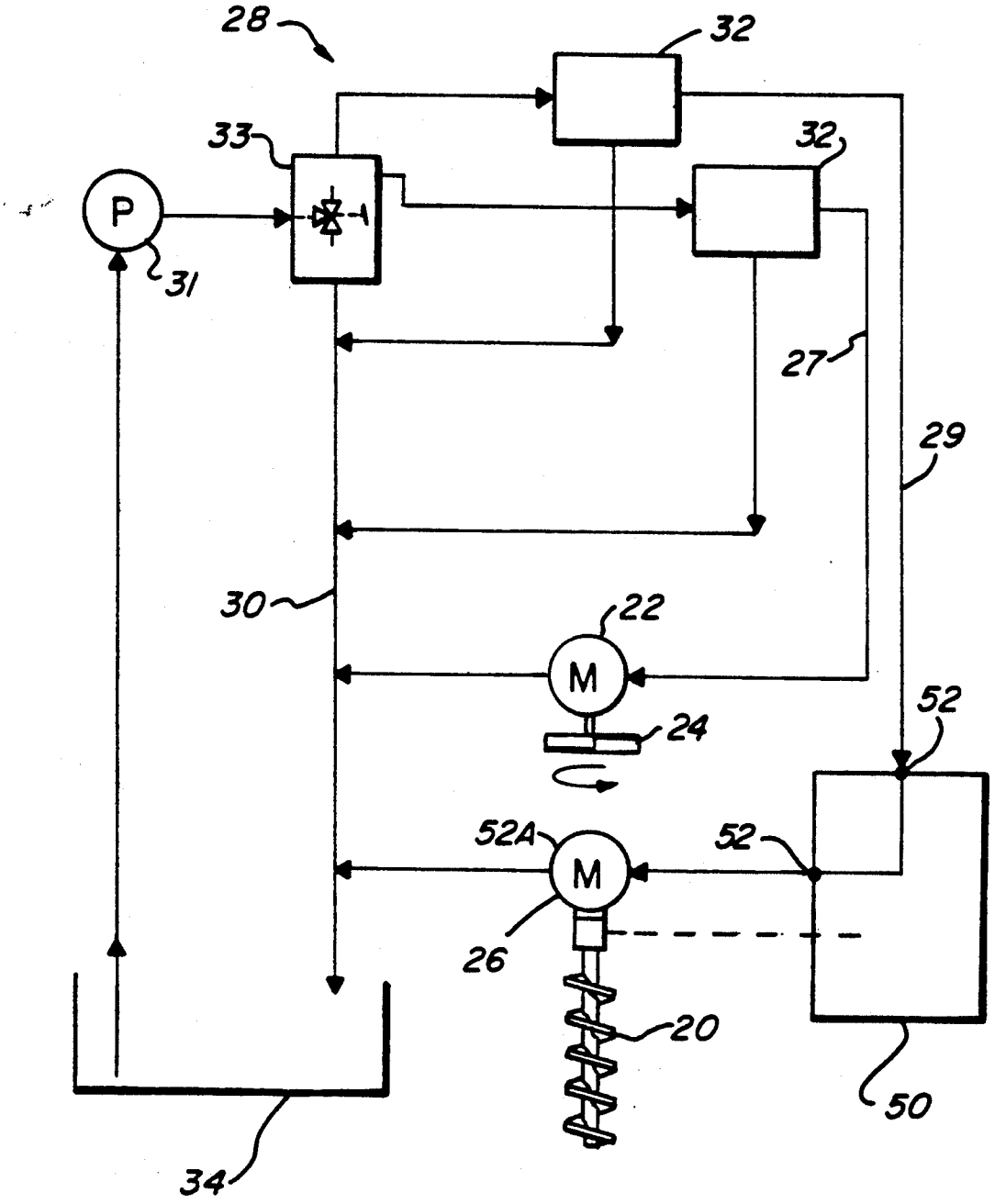
FIG. 4 is a schematic view of the hydraulic system of the granular delivery system.

Conveyor 20 and the spinner 24 are driven by motors 26, 22 powered by the vehicle hydraulic system 28 (FIG. 4). The hydraulic system 28 is conventional in the art and includes a power take off connection from the vehicle engine which drives a hydraulic pump 31. When the hydraulic system 28 is turned on by a switch 33, hydraulic fluid is diverted as shown in FIG. 4, to hydraulic lines 27 and 29 connected to the spinner motor 22 and conveyor motor 26, respectively. Rotary valves 32 in lines 27 and 29 determine the amount of hydraulic fluid delivered. If the hydraulic system 28 is turned off at the switch 33, hydraulic fluid is returned to a fluid reservoir 34, through a by-pass line 30.

While the conveyor 20 is shown as an auger type conveyor, it could be a roller device or belt conveyor, depending upon the choice of the user. A granular material delivery system 23 (FIGS. 5, 6) is comprised of the hydraulic system 28, the hopper 14, the conveyor 20 and the spinner 24.

A liquid delivery line 36 carries the liquid 17 from the storage tank 16 to one or more of the nozzles 21 which apply the liquid 17 under pressure to the falling granular material 15 generally at the spinner 24, or directly onto the roadway surface. In a manner known in the art, the area covered is determined by the rotational speed of the spinner 24, while the amount of granular material 15 dispensed is determined by the speed of the conveyor 20, the speed of the vehicle and mechanical considerations related to the hopper 14.

The liquid delivery system 25 includes, generally, the tank 16, the delivery lines 36, a liquid system motor 38, a liquid system pump 40, a liquid flow control valve 42, a flow meter 44 and the distribution nozzles 21. (FIGS. 5-8). The liquid delivery system 25 is interconnected to the granular material delivery system 23 to synchronize the feed rate of the liquid 17 to the granular material 15.

In the embodiment shown in FIG. 3, the liquid pump 40 of the liquid delivery system 25 is mechanically connected through a gear box 46 to a shaft of the conveyor 20. In the hydraulic embodiments of FIGS. 5 through 10, the liquid system pump 40 is mechanically connected to a drive motor 38, which is in turn in fluid communication with the vehicle hydraulic system 28.

The liquid pump 40 partially determines the feed rate of the liquid 17 supplied to a liquid flow control valve 42, which determines the actual amount or feed rate of the liquid 17 delivered to the nozzles 21. The liquid flow control valve 42 either controls the liquid flow directly or recirculates a selected amount of the liquid 17 to the tank 16. Either way, the amount of liquid feed is infinitely variable over a given range. In the embodiments shown in FIGS. 3 and 5 through 10, the liquid pump motor 38 (not shown in FIG. 3) and the liquid pump 40 are connected so that the feed rates of the granular material 15 and liquid 17 are likewise synchronous, depending upon the speed of the conveyor 20. Variation of liquid flow rate to granular flow rate is partially achieved by altering the amount of the liquid 17 returned to the tank 16 through the liquid flow control valve 42. Liquid flow is further affected by diverting hydraulic fluid from the hydraulic system 28, as will be described in reference to the embodiments of FIGS. 7 through 10.

Figure 5:
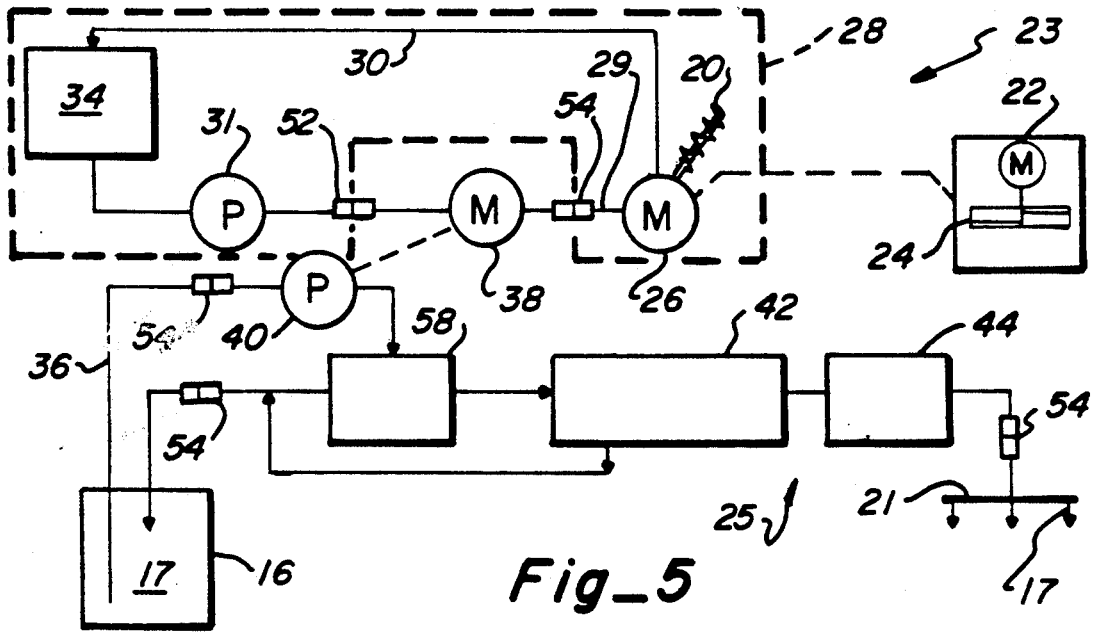
FIG. 5 is a block diagram of a first alternative hydraulic embodiment of the granular and liquid delivery system of the invention.
Figure 6:
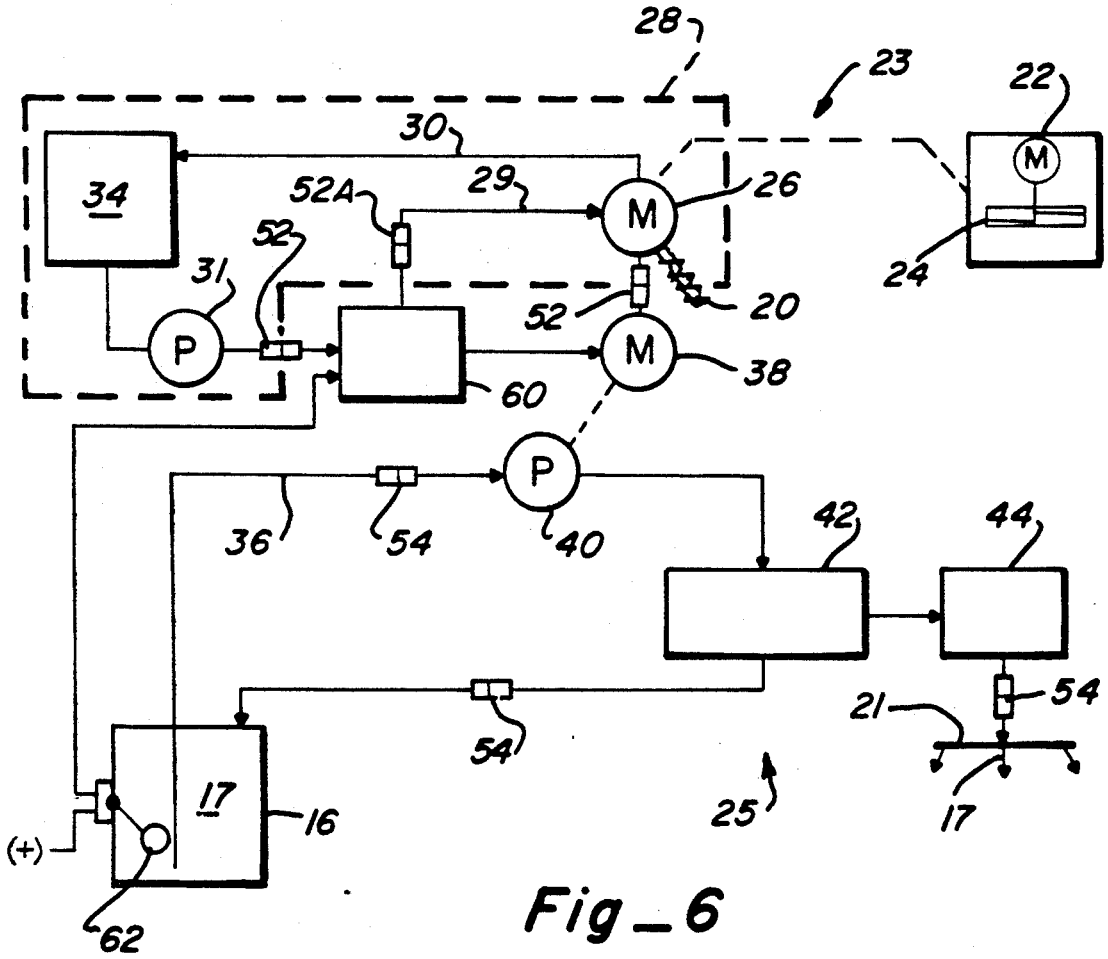
FIG. 6 is a schematic view of a second alternative hydraulic embodiment of the invention.

Like parts retain the same numbers in the description of the following embodiments. Different embodiments of the liquid delivery system 25 and its connection to the granular delivery system 23 are shown in FIGS. 3 and 5 through 10. In FIGS. 5 through 10, the hydraulic lines connecting the spinner motor 22 and the spinner 24 to the remainder of the hydraulic system 28 are shown schematically for clarity. The embodiments of FIGS. 5 and 6 are similar in that the hydraulic fluid is not diverted from the hydraulic system 28. In the embodiments shown in FIGS. 7 and 8, a hydraulic fluid flow control valve 48 and a direction control valve 50 are upstream of the conveyor motor 26. Hydraulic fluid flow is diverted from the hydraulic system 28 through the flow control valve 48, at the discretion of the operator, to between 0 and approximately 95% of the total hydraulic fluid flow. This provides much greater flexibility in adjusting the granular material 15 usage to the temperature, wind, depth and types of precipitation.

In all embodiments of the liquid delivery system 25 the connection between the granular delivery system 23 and the pump 40 provides for synchronous delivery of liquid 17. The faster that granular material 15 is delivered by the granular delivery system 23, specifically the conveyor motor 26, the more rapid a rate that liquid 17 is applied. This is necessary to keep the ratio of the liquid 17 to the granular material 15 constant, i.e., synchronous.

The entire liquid delivery system 25 can be removed from the spreader device 10 through quick release disconnects 52 and 54. The quick release disconnects 52 remove the liquid delivery system 25 from the hydraulic system 28 as will be described shortly. The quick release disconnects 54 allow the liquid delivery system 25 to be separated from the liquid tank 16 and the nozzles 21. Removal of the liquid delivery system 25 is provided so that testing, calibration, repair or even replacement can be accomplished in as quick and timely a manner as possible. While the liquid delivery system 25 is removed, the granular delivery system 23 is operable in a normal manner. The connections 52 of the embodiment of FIGS. 3 and 5 through 9 to the hydraulic system 28 are shown in FIG. 4.

The mechanical embodiment of FIG. 3 directly connects a rotating shaft of the conveyor 20 to the liquid system pump 40. (FIGS. 3 and 4). The connection establishes a synchronous feed rate between the liquid 17 and the granular material 15. The liquid delivery system 25 of this embodiment is as discussed in reference to the embodiment of FIG. 5, which will now be described.

In the embodiment shown in FIG. 5, the hydraulic system 28 includes the hydraulic fluid tank 34 from which hydraulic fluid is delivered into the hydraulic fluid lines 29 and 30. The liquid system motor 38 is connected to the hydraulic system 28 intermediate to the pump 31 and the separate conveyor motor 26 at quick release disconnects 52, 54. The hydraulic fluid flow in the line 29 is used by the motor 38 to establish a rotary motion to turn the pump 40 of the liquid delivery system 25. The hydraulic flow in the line 29 also powers the conveyor 20 through the separate conveyor motor 26.

Still referring to FIG. 5, the pump 40 is synchronized mechanically to the granular material delivery system 23. Liquid 17 from the liquid storage tank 16 is drawn through the delivery line 36 by the pump 40 and through a liquid direction control valve 58 either back to the storage tank 16 or to the flow control valve 42. If the liquid 17 is returned to the storage tank 16, no liquid 17 is applied to the granular material 15. If the liquid 17 passing through the direction control valve 58 is not returned to the tank 16, then adjustment of the flow control valve 42 determines how much of the liquid 17 is applied to the nozzles 21 and how much is returned to the tank 16. The flow control valve 42 therefore determines the amount of liquid 17 applied to the road 13 and adjusts, up or down, the ratio of feed rates of liquid 17 to the granular material 15 that is dictated by the interconnection between the pump 40 and the motor 38. The flow meter 44 measures the rate of flow of the liquid 17 so that the ratio of liquid 17 to granular material 15 can be measured and analyzed at a later date.

In the embodiment shown in FIG. 6, using a hydraulic direction control valve 60, the granular material delivery system 23 selectively diverts a portion of the hydraulic flow away from the hydraulic system 28 to the liquid system motor 38 of the liquid delivery system 25. The conveyor motor 26 receives the fluid flow either directly or through the liquid system motor 38, mounted in line or in series with the conveyor motor 26, to turn the conveyor 20. In the first setting of the direction control valve 60, the liquid delivery system 25 is activated or on. In the second setting of the valve 60, only the operation of the separate conveyor motor 26 is selected. In that case, the liquid delivery system 25 is off. In a similar manner to that described with reference to FIG. 5, the direction control valve 60 and the liquid system motor 38 are inserted into the hydraulic line 29 intermediate to the pump 31 and the conveyor motor 26 at the quick release disconnects 52. The second setting of the direction control valve 60 requires a third quick release disconnect 52A to the hydraulic system 28. The quick release disconnect 52A interconnects the direction control valve 60 and the motor 26 (FIG. 6).

If the liquid delivery system 25 is on, i.e., motor 38 is activated by setting the direction control valve 60, then the pump 40 operates as previously described forcing fluid through the flow control valve 42 and the flow meter 44 to the nozzles 21. A liquid level indicator 62 can be mounted in the liquid tank 16 selecting the first setting, to turn off the liquid delivery system 25 at the direction control valve 60, if the liquid 17 goes below a certain predetermined level.

Figure 7:
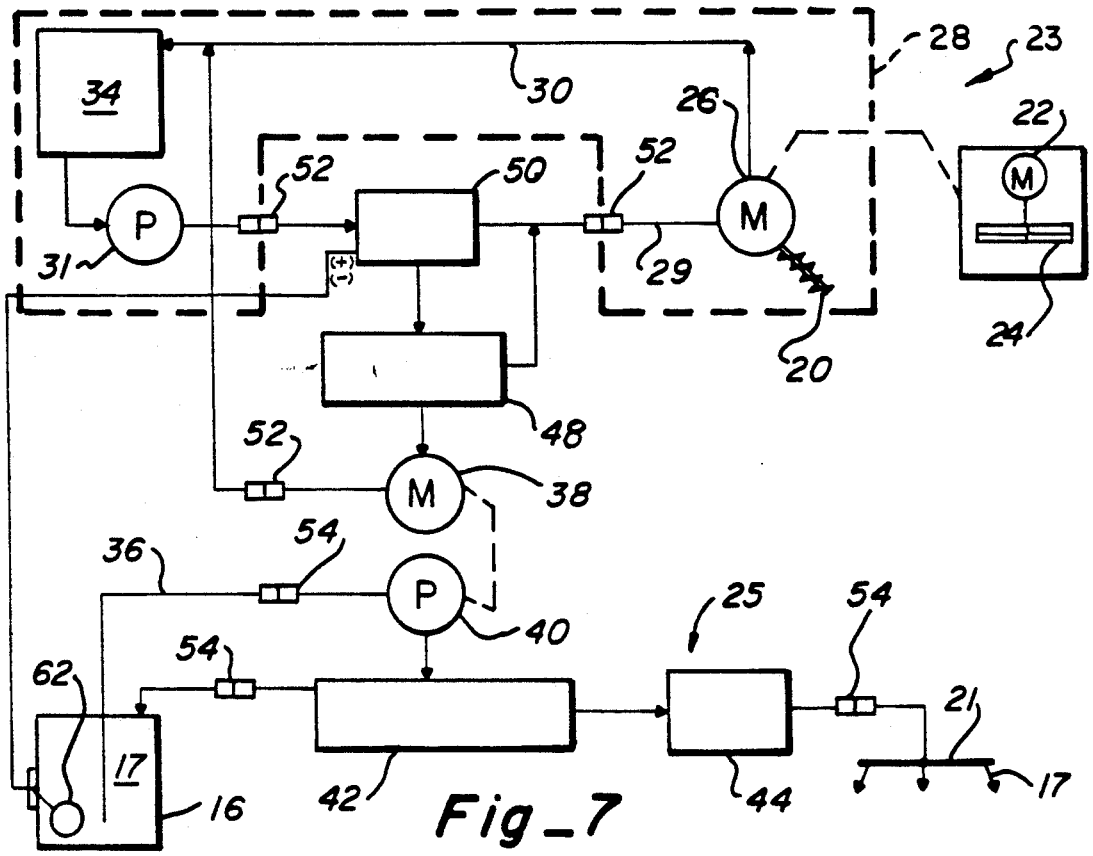
FIG. 7 is a schematic view of a third alternative hydraulic embodiment of the invention.

In the embodiment shown in FIG. 7 the hydraulic direction control valve 50 is utilized in a first setting to solely direct fluid to the separate conveyor motor 26 or, through the hydraulic flow control valve 48, in a second setting directs fluid to the liquid system motor 38 and the conveyor motor 26. As has been discussed in other embodiments, if the separate conveyor motor 26 is selected by the direction control valve 50, the liquid delivery system 25 is shut off. If the flow control valve 48 is selected by the direction control valve 50, a selected constant percentage of the hydraulic fluid is available to operate the liquid system motor 38, with the balance operating the separate conveyor motor 26.

The diverted hydraulic fluid is returned to the reservoir 34. The percent of fluid diverted to the motor 38 is set at a constant but may be changed to any of an infinite number of settings over a range by the operator, altering the feed rate of the granular delivery system 23. The flow control valve 48 and direction control valve 50 thereby define diversion means for diverting hydraulic fluid from the granular material delivery system 23 to the liquid delivery system 25. The direction control valve 50 is connected at the quick release disconnects 52 intermediate the pump 31 and the conveyor motor 26, defining the connection (not shown) to the hydraulic system 28 (FIG. 4).

As before, the liquid system motor 38 mechanically drives the pump 40, the liquid 17 is forced through the variable flow control valve 42 and the flow meter 44 to the nozzles 21. The level indicator 62 operates the direction control valve 50 to enable or disable the liquid delivery system 25, depending upon the level of liquid 17 in the tank 16.

Figure 8:
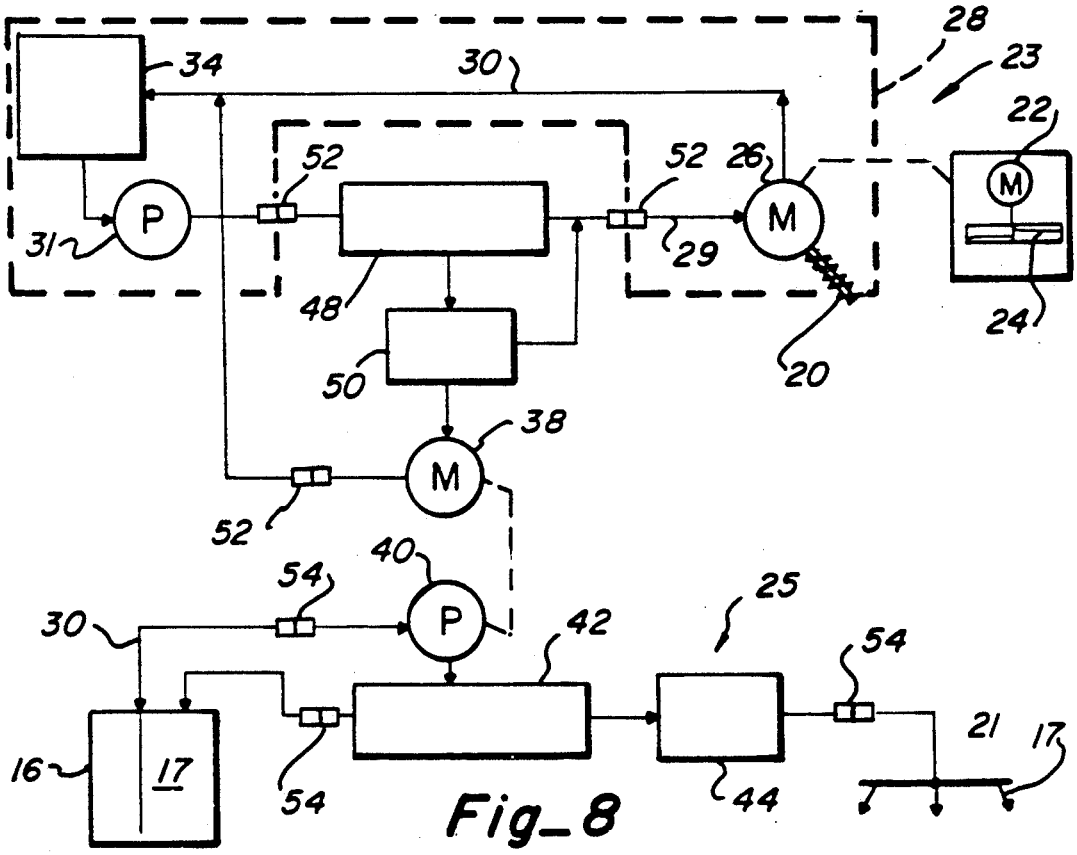
FIG. 8 is a schematic view of a fourth alternative hydraulic embodiment of the invention.

In the embodiment shown in FIG. 8, a desired percentage of hydraulic fluid is diverted at the variable flow control valve 48 from hydraulic system 28 to the liquid delivery system 25. The direction control valve 50 may restore the diverted percentage of hydraulic fluid to the separate conveyor motor 26 or activate the liquid delivery system 25 by supplying the diverted hydraulic fluid to the liquid system motor 38. All of the hydraulic fluid is eventually returned to the hydraulic storage tank 34. The flow control valve 48 is again interconnected into the hydraulic line 29 at the quick release disconnects 52 (FIG. 8).

Figure 9:
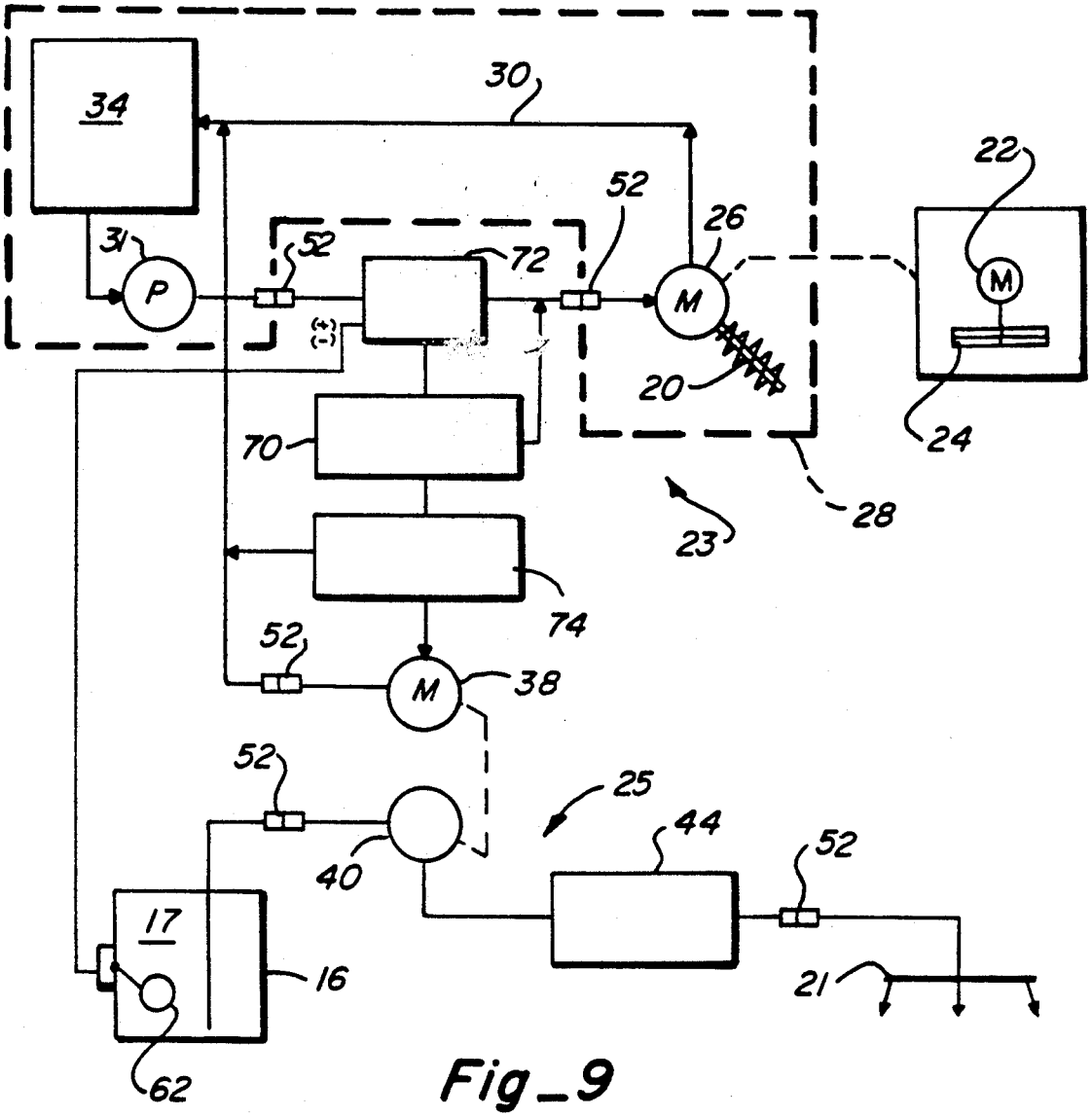
FIG. 9 is a schematic view of a fifth alternative hydraulic embodiment of the invention.

In the embodiment shown in FIG. 9, the feed rate of the liquid delivery system 25 is controlled entirely through the hydraulic system 28. This eliminates the need for the liquid flow control valve, 42. Rather, the first and second variable control valves 70 and 74, as well as directional flow control valve 72, are placed in the hydraulic system 28 upstream of the liquid system motor 38.

In a manner analogous to the other embodiment, FIG. 9 shows a circuit in which hydraulic fluid is removed from the reservoir 34 and delivered into the hydraulic lines 30 under pressure imparted by the hydraulic pump 31. Hydraulic fluid passes through a direction control valve 72 downstream of the pump 31. As before, depending on the position of the direction flow control valve 72, the liquid delivery system 25 is either on or off. If the flow control valve 72 is set to turn the liquid delivery system 25 off, then all the hydraulic fluid is directed toward the conveyor motor 26 of the granular delivery system 23. If the direction flow control valve 72 is on, then the hydraulic fluid is directed through the first variable flow control valve 70, which sets the percentage of reduction as has been discussed with respect to FIGS. 7 and 8. A percentage of hydraulic fluid is diverted to the liquid delivery system 25, and the remainder is used to drive the granular delivery system 23. Hydraulic fluid then passes through the second variable flow control valve 74. At the control valve 70, the feed rate of the liquid delivery system 25 is set. Depending on the setting of the second variable flow control valve 74, the liquid delivery system 25 operates at a full feed rate for the liquid 17 or at a lesser feed rate. In this manner, the amount of hydraulic fluid supplied to the pump motor 38 controls the feed rate of the liquid 17, rather than the flow control valve 42 of the other alternative embodiments. As in the other embodiments, the liquid feed rate is constant within a range. As seen in FIG. 9, any excess hydraulic fluid is returned to the hydraulic system 28 and eventually to the reservoir 34.

It will be apparent to those of skill in the art that the position of the direction control valve 72 and the variable flow control valve 70 can be switched to achieve the identical operational result. A level indicator can be included to force the directional flow control valve 72 off.

In the embodiments of FIGS. 7, 8, 9 and 10, the diversion means for diverting hydraulic fluid from the granular material delivery system 23 proportionately reduce the speed of the conveyor 20 by a percentage equal to the amount of fluid diverted away from the conveyor motor 26 to the reservoir 34. The feed rate of the granular delivery system 23 is reduced, and the amount of granular material 15 deposited on the road 13 is likewise reduced, while synchronous operation with the liquid delivery system 25 is maintained. If the diversion means is off, then the conveyor 20 returns to its previous operational speed. This is best seen in the following examples, which compare the embodiments of FIGS. 3, 5 and 6, which do not reduce the feed rate of the granular delivery system 23, to the embodiments of FIGS. 7, 8 and 9, which do reduce the feed rate.

| EXAMPLE 1 | FIG. 3 | FIG. 5 | FIG. 6 | FIG. 7 | FIG. 8 | FIG. 9 |
|---|---|---|---|---|---|---|
| Engine RPM | 1000 | 1000 | 1000 | 1000 | 1000 | 1000 |
| Inlet Hydraulic Fluid Flow in GPM | 10 | 10 | 10 | 10 | 10 | 10 |
| Hydraulic Fluid Diversion: | | | | | | |
| Percent Diverted to Liquid Delivery System | N/A | N/A | N/A | 30% | 30% | 30% |
| Gallons Diverted to Liquid Delivery System | N/A | N/A | N/A | 3 | 3 | 3 |
| Conveyor Speed in RPM: | | | | | | |
| Without Fluid Diversion | 50 | 50 | 50 | 50 | 50 | 50 |
| With Fluid Diversion | 50 | 50 | 50 | 35 | 35 | 35 |
| Granular Material Usage: | | | | | | |
| Salt - (lbs. Per Lane Mile) | 400 | 400 | 400 | 400 | 400 | 400 |
| Without Fluid Diversion | 400 | 400 | 400 | 280 | 280 | 280 |
| With Fluid Diversion | | | | | | |
| Salt Savings Due to Diversion | N/A | N/A | N/A | 120 | 120 | 120 |
| During Liquid Application: | | | | | | |
| Liquid Material Usage: | | | | | | |
| Without Fluid Diversion | 20 | 20 | 20 | 0 | 0 | 0 |
| With Fluid Diversion | 20 | 20 | 20 | 14 | 14 | 14 |
| Liquid Savings Due to Diversion | | N/A | N/A | N/A | 6 | 66 |

| EXAMPLE 2 | FIG. 3 | FIG. 5 | FIG. 6 | FIG. 7 | FIG. 8 | FIG. 9 |
|---|---|---|---|---|---|---|
| Engine RPM | 2000 | 2000 | 2000 | 2000 | 2000 | 2000 |
| Inlet Hydraulic Fluid Flow in GPM | 20 | 20 | 20 | 20 | 20 | 20 |
| Hydraulic Fluid Diversion: | | | | | | |
| Percent Diverted to Liquid Delivery System | | N/A | N/A | N/A | 30% | 30% 30% |
| Gallons Diverted to Liquid Delivery System | | N/A | N/A | N/A | 6 | 66 |
| Conveyor Speed in RPM: | | | | | | |
| Without Fluid Diversion | 100 | 100 | 100 | 100 | 100 | 100 |
| With Fluid Diversion | 100 | 100 | 100 | 70 | 70 | 70 |
| Granular Material Usage: | | | | | | |
| Salt - (lbs. Per Lane Mile) | | | | | | |
| Without Fluid Diversion | 800 | 800 | 800 | 800 | 800 | 800 |
| With Fluid Diversion | 800 | 800 | 800 | 560 | 560 | 560 |
| Salt Savings Due to Diversion | N/A | N/A | N/A | 240 | 240 | 240 |
| During Liquid Application: | | | | | | |

-continued

| EXAMPLE 2 | FIG. 3 | FIG. 5 | FIG. 6 | FIG. 7 | FIG. 8 | FIG. 9 |
|---|---|---|---|---|---|---|
| Liquid Material Usage: | | | | | | |
| Without Fluid Diversion | 40 | 40 | 40 | 0 | 0 | 0 |
| With Fluid Diversion | 40 | 40 | 40 | 28 | 28 | 28 |
| Liquid Savings Due to Diversion | N/A | N/A | N/A | 12 | 12 | 12 |

The assumptions in the foregoing examples are a 30% reduction in conveyor speed due to diversion of fluid. It is also assumed that the ratio of the liquid 17 to the granular material (salt) 15 will be 5% by weight. Use of the embodiments of FIGS. 7, 8 and 9 reduces use of salt 120 lbs. and liquid 6 gallons in Example 1. For Example 2, the reductions are 240 lbs. and 12 gallons.

Those of ordinary skill in the art will appreciate that reduction, or proportional change, of the feed rate of the granular delivery system 23 may result from other mechanical and electronic means. Specifically, the liquid feed rate could be measured electronically, and a signal proportional to the feed rate would proportionately open and close a valve (not shown) in the hydraulic system 28. The opening and closing of the valve would affect the amount of hydraulic fluid supplied to the conveyor motor 26, raising or lowering the feed rate of granular material.

In all of the embodiments discussed, reduction of the feed rate of the granular delivery system 23 resulted from diversion of hydraulic fluid to the liquid delivery system 25. It is also contemplated in the embodiment shown in FIG. 10 of the present invention to reduce the feed rate of the granular delivery system 23 by diverting hydraulic fluid from the conveyor motor 26 in a proportional amount and returning the hydraulic fluid to the reservoir 34 rather than to the liquid delivery system 25. Such a diversion is accomplished by a variable flow control valve 82 and a direction control valve 80 similar to valves 48 and 50 described in reference to the embodiment shown in FIG. 7. The variable flow control valve 82 is placed in line so as to be upstream from the conveyor motor 26. A proportional amount of hydraulic fluid is thus directed to the liquid and conveyor motors 38 and 26 and the remaining and proportional amount of hydraulic fluid in the hydraulic system 28 is returned to the reservoir 34 by the variable flow control valve 82.

To achieve the desired reduction of the granular material feed rate, the variable flow control valve 82 returns the remaining proportional amount of the hydraulic fluid to the reservoir 34. The direction control valve 80 can be electronically connected as described previously to activate or deactivate the liquid delivery system 25. If the direction control valve 80 is set to direct fluid to the conveyor motor 26 only, no reduction in hydraulic flow, and, therefore, no reduction in granular material feed rate occurs nor is liquid added.

Figure 10:
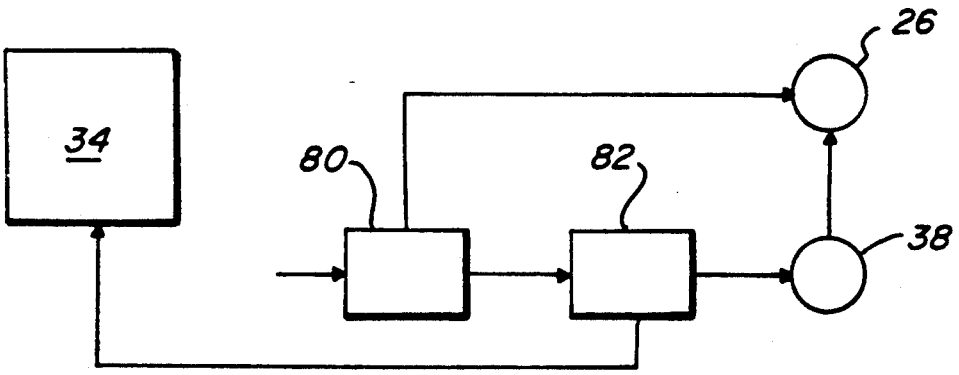
FIG. 10 is a schematic view of a sixth alternative hydraulic embodiment of the invention.

The liquid system motor 38 in the embodiment of FIG. 10 could be placed in series with the conveyor motor 26 on either side thereof. The only requirement is that the liquid system motor 38 be downstream of the variable flow control 82. Other arrangements of the valves and motors will be apparent to those of ordinary skill in the art.

Figure 11:
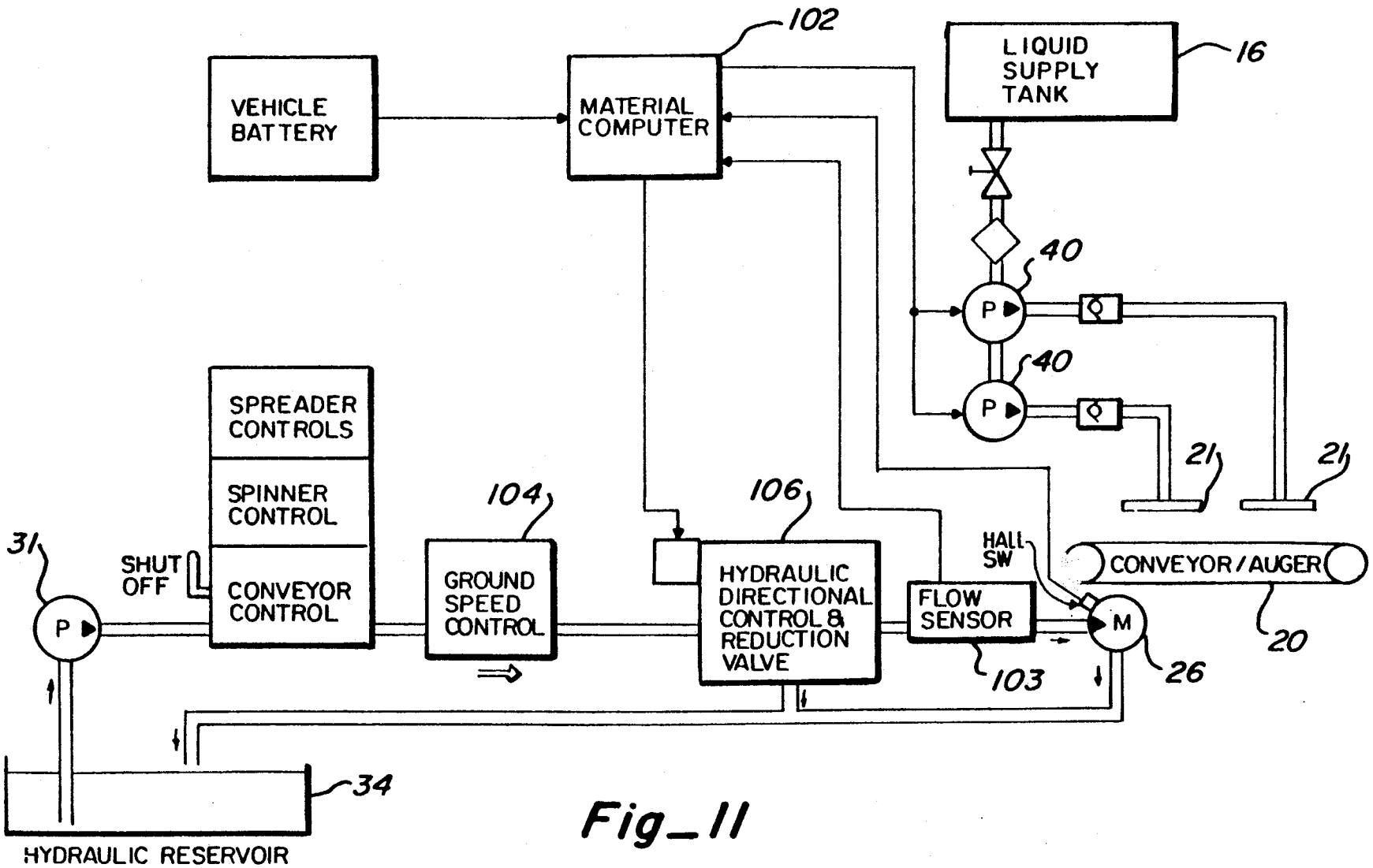
FIG. 11 is a diagrammatic representation of a control system embodying the present invention.

An improved control system 100 for the spreader is shown in FIGS. 11, 12*a*, 12*b* and 12*c*. This control system 100 includes a material computer 102 which may either utilize the existing ground speed control 104 or replace it. Ground speed control is known in the prior art and is used to adjust the speed of the conveyor 20 according to the speed of travel of the vehicle 12 carrying the aggregate conveyor 20 and the actual conveyor speed. As shown in FIGS. 11 and 12, the ground speed control 104 is incorporated into or associated with the material computer 102 of the improved delivery system 100.

As has been previously described generally, the vehicle hydraulic pump 31 (FIG. 11) pumps hydraulic fluid through a directional flow control valve 106 which directs hydraulic fluid to the conveyor motor 26, activating the delivery system, or diverts the hydraulic fluid to the reservoir 34. The flow of hydraulic fluid to the conveyor motor is sensed by a flow sensor 108 which generates a signal as a function of the conveyor speed and sends the signal as an input signal to the material computer 102.

Unlike the hydraulic and mechanical reduction delivery systems shown in FIGS. 7–10, the improved embodiment shown in FIG. 11 controls the liquid material feed rate electronically by programming the material computer 102 as a function of the granular material feed rate. The material computer sets the speed at which liquid pumps 40 are driven by a liquid system motor (not shown). For any given granular material feed rate, the liquid feed rate may be changed by manually setting the material computer 102. Upon activation of the material delivery system 100, the motor 26 drives the aggregate conveyor 20, which moves at a preselected or determined speed. A conveyor speed sensor 110 generates a signal which is directed to the computer 102 which in turn constantly adjusts the proportion of hydraulic fluid diverted by the control valve 106.

As determined by the speed of the conveyor 20, the material computer 102 controls the speed at which the pumps 40 feed the liquid 17 from the liquid supply tank 16 to the spray nozzles 21. The vehicle operator can vary within selected rates the amount at which the granular delivery system delivers aggregate material as in the previously described embodiments.

Figure 12A:
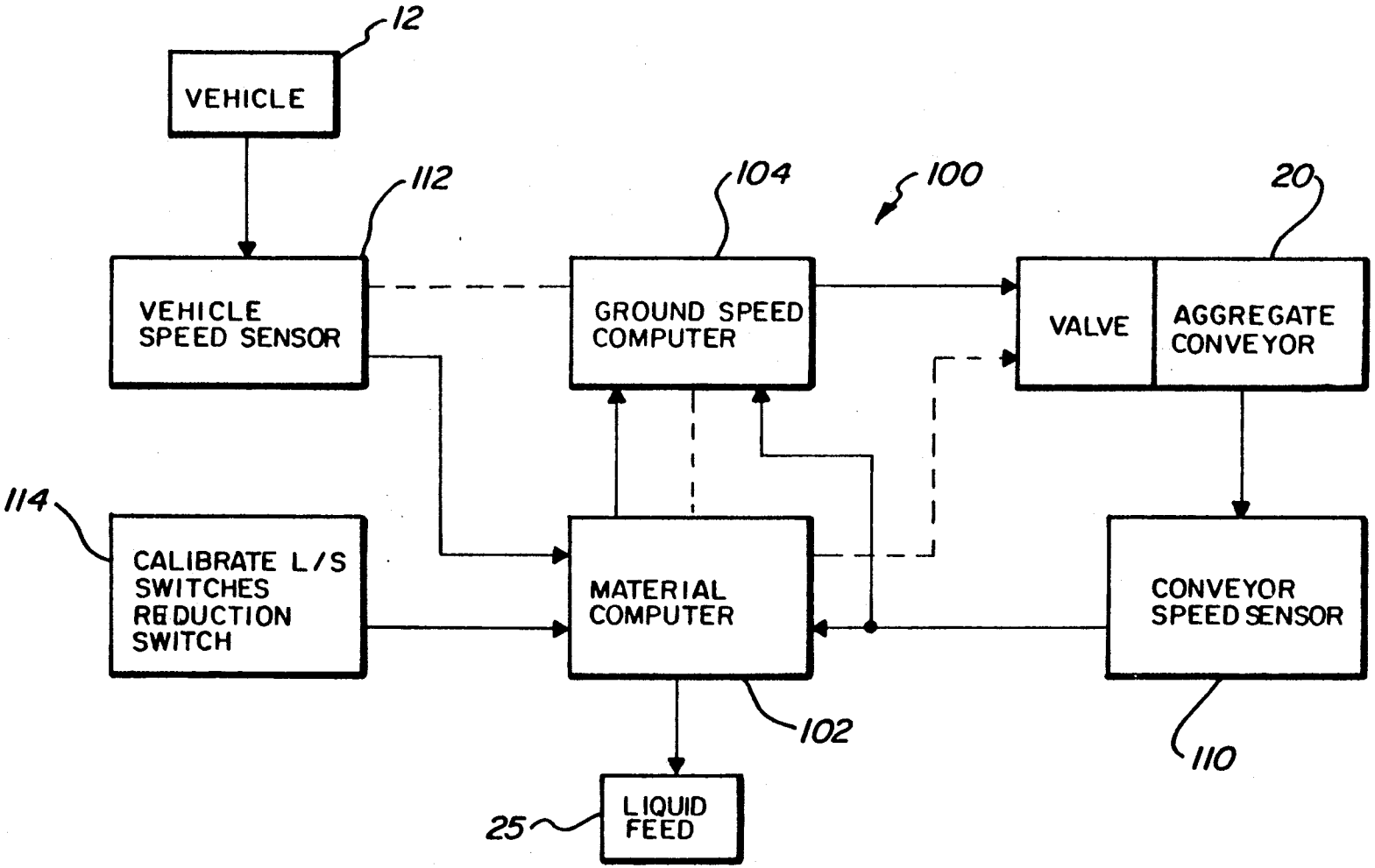
FIGS. 12*a*, b and c are diagrams representing modification of the present invention.

As shown in FIG. 12*a*, a vehicle speed sensor 112 generates a signal as a function of vehicle speed, which signal is fed directly to the material computer 102. The conveyor speed sensor 110 generates a signal as a function of the aggregate conveyor 20 speed, which signal is also fed to the material computer and optimally to the ground speed computer 104, in an optional feedback loop. Based on an already established granular feed reduction rate selected at a liquid/solid control switch 114, the material computer 102 establishes an adjusted speed input signal which is transmitted to the ground speed computer 104 for controlling the speed of the aggregate conveyor 20. The material computer 102 further activates and controls the liquid material system by generating and transmitting a control signal thereto.

Figure 12B:
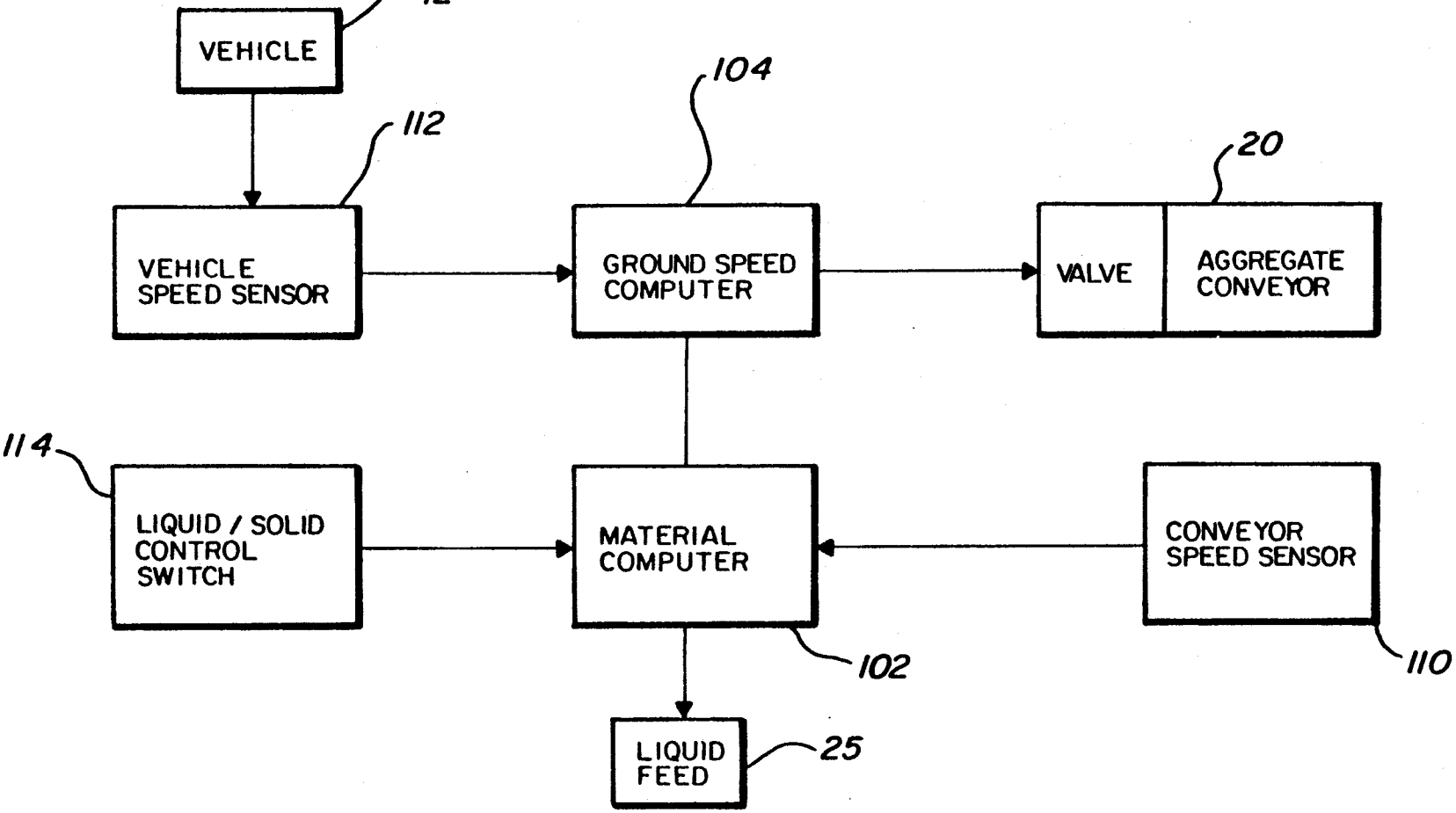

As shown in FIG. 12*b*, the vehicle speed sensor 112 generates a signal as a function of vehicle speed which signal is fed to the ground speed computer 104. The conveyor speed sensor 110 generates a signal which is transmitted to the material computer 102. An adjusted conveyor speed signal is developed by the material computer 102 and transmitted to the ground speed computer which effectively lowers the aggregate conveyor speed. The material computer also generates a signal which is used to activate and control the liquid delivery.

Figure 12C:
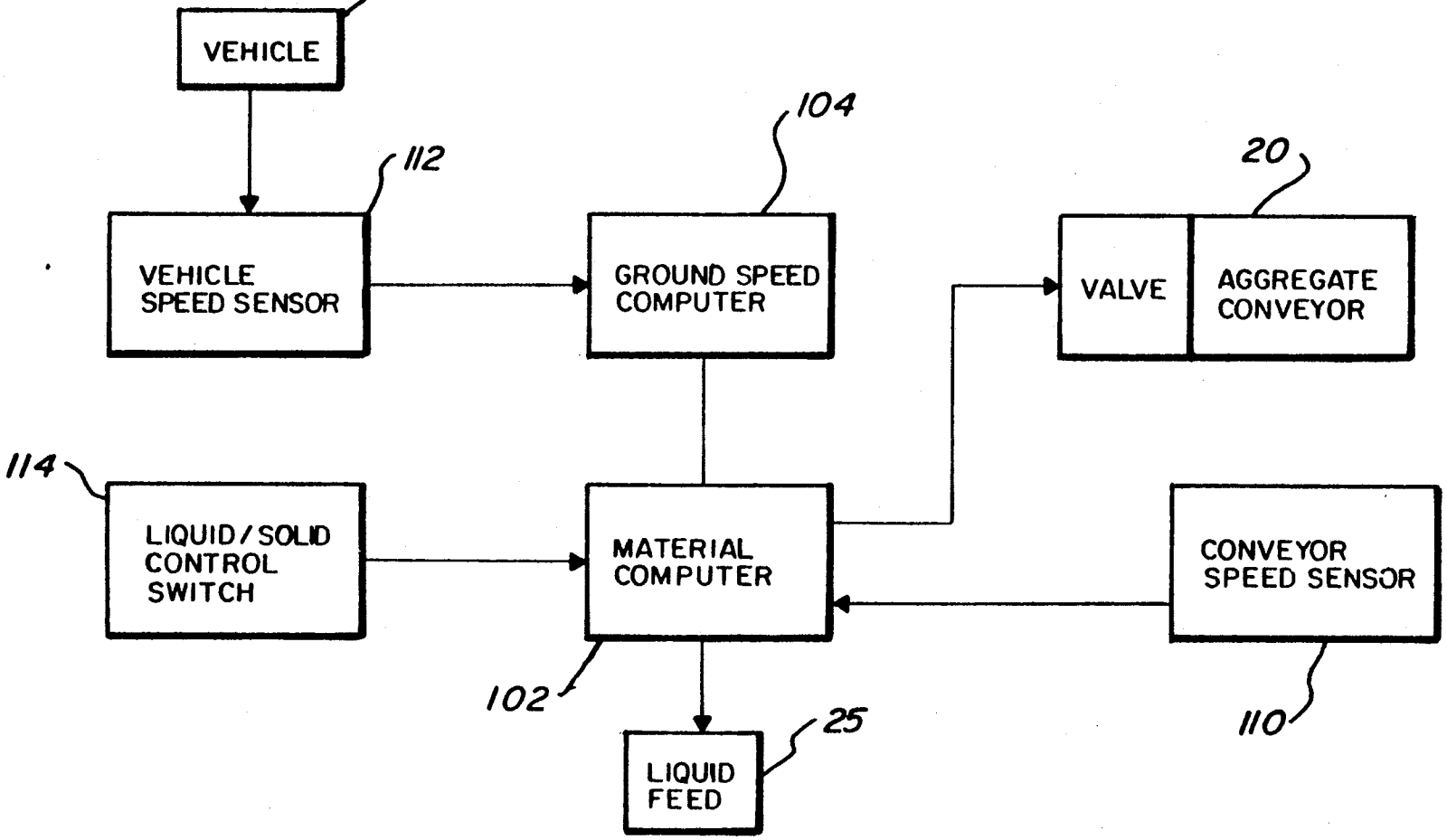

The modified control system shown in FIG. 12*c* is similar to that shown in FIG. 12*b*, with the exception that the ground speed computer 104 output signal is transmitted to the material computer 102, which then directly controls the speed of the aggregate conveyor 20 and liquid feed.

Although the invention has been described with a certain degree, of particularity, the scope of the invention is defined in the appended claims.

We claim:

1. A spreader for granular and liquid materials comprising a vehicle including a hydraulic system, a storage hopper mounted on said vehicle for containing granular material, a granular material delivery apparatus including a conveyor driven by said hydraulic system for moving the granular material from the hopper to a delivery position and means at said delivery position for receiving and distributing said granular material onto a roadway surface, a controller for controlling the speed of said conveyor, means for sensing conveyor speed and generating a conveyor speed signal, a liquid material storage tank mounted on said vehicle, a liquid material delivery apparatus including a conduit for supplying liquid material from said tank to a delivery position and means at said delivery position for distributing said liquid material, wherein the improvement comprises a material computer for controlling the feed rates of the granular and liquid materials, said material computer including mean for receiving said conveyor speed signal and generating first and second signals as a function of said sensed conveyor speed, said material computer including means for directing said first signal to said controller for controlling the delivery of said granular material, said material computer including means for directing said second signal to said liquid material delivery apparatus for controlling the delivery of liquid material thereby, means for selectively generating and directing a third signal to said material computer to actuate said liquid material delivery apparatus, said third signal generating and directing means including means for selectively presetting the rate of liquid material delivery within a selected range of feed rates, said material computer including mean for selectively setting the granular material feed rate within a selected range of feed rates, said material computer including means for maintaining a predetermined ratio of said feed rate of liquid material to said feed rate of granular material, and said material computer including means responsive to actuation of said liquid material delivery apparatus for reducing by a variably selected percentage the quantity of granular material delivered by said granular material delivery apparatus while maintaining said predetermined ratio of the feed rates of delivery of liquid and granular materials.

2. A spreader for granular and liquid materials comprising a vehicle including a hydraulic system, a storage hopper mounted on said vehicle for containing granular material, a ground speed computer including means for sensing vehicle speed and generating a vehicle speed signal, a granular material delivery apparatus including a conveyor controlled by said ground speed computer and driven by said hydraulic system for moving the granular material from the hopper to a delivery position and means at said delivery position for receiving and distributing said granular material onto a roadway surface, said ground speed computer including means for controlling said granular material delivery apparatus, means for sensing conveyor speed and generating a conveyor speed signal, a liquid material storage tank mounted on said vehicle, and a liquid material delivery apparatus including a conduit for supplying liquid material from said tank to a delivery position and means at said delivery position for distributing said liquid material, wherein the improvement comprises a material computer for controlling the feed rates of the granular and liquid materials, said material computer including means for receiving said vehicle speed signal and generating a first signal as a function of said sensed vehicle speed, said material computer including means for receiving said conveyor speed signal and generating a second signal as a function of said sensed conveyor speed, said material computer including means for directing said first signal to said ground speed computer for controlling the delivery of said granular material, said material computer including means for directing said second signal to said liquid material delivery apparatus for controlling the delivery of liquid material thereby, means for selectively generating and directing a third signal to said material computer to actuate said liquid material delivery apparatus, said third signal generating and directing means including means for selectively presetting the rate of liquid material delivery within a selected range of feed rates, said material computer including means for selectively setting the granular material feed rate within a selected range of feed rates, said material computer including means for being maintaining a predetermined ratio of said feed rate of liquid material to said feed rate of granular material, and said material computer including means responsive to actuation of said liquid material delivery apparatus for reducing by a variably selected percentage the quantity of granular material delivered by said granular material delivery apparatus while maintaining said predetermined ratio of the feed rates of delivery of liquid and granular materials.

3. A spreader for granular and liquid materials comprising a vehicle including a hydraulic system, a storage hopper mounted on said vehicle for containing granular material, a ground speed computer including means for sensing vehicle speed and generating a vehicle speed signal, a granular material delivery apparatus including a conveyor controlled by said ground speed computer and driven by said hydraulic system for moving the granular material from the hopper to a delivery position and means at said delivery position for receiving and distributing said granular material onto a roadway surface, said ground speed computer including means for controlling said granular material delivery apparatus, means for sensing conveyor speed and generating a conveyor speed signal, a liquid material storage tank mounted on said vehicle, and a liquid material delivery apparatus including a conduit for supplying liquid material from said tank to a delivery position and means at said delivery position for distributing said liquid material wherein the improvement comprises a material computer for controlling the feed rates, of the granular and liquid materials, said material computer including mean for receiving said vehicle speed signal and generating a first signal as a function of said sensed vehicle speed, said material computer including means for receiving said conveyor speed signal and generating a second signal as a function of said sensed conveyor speed, said material computer including means for directing said first signal to said ground speed computer for controlling the delivery of said granular material, said material computer including means for directing said second signal to said liquid material delivery, apparatus for controlling the delivery of liquid material thereby, said material computer including means for selectively setting the liquid material feed rate within a selected range of feed rates, said material computer including means for selectively setting the granular material feed rate within a selected range of feed rates, said material computer including means for maintaining a predetermined ratio of said feed rate of liquid material to said feed rate of granular material, and said material computer including means responsive to actuation of said liquid material delivery apparatus for reducing by a variably selected percentage the quantity of granular material delivered by said granular material delivery apparatus while maintaining said predetermined ratio of the feed rates of delivery of liquid and granular materials.

4. A spreader as defined in claim 3 wherein the improvement further comprises means for selectively generating and directing a third signal to said material computer to actuate said liquid material delivery apparatus.

5. A spreader as defined in claim 4 wherein said third signal generating means includes means for selecting the rate of liquid material delivery.

* * * * *